US005105561A

United States Patent [19]

Wulz

[11] Patent Number: 5,105,561

[45] Date of Patent: Apr. 21, 1992

[54] WEB AND SUPPORT BELT SEPARATION FOR DRY END OF PAPER MACHINE

[75] Inventor: Hans-Jürgen Wulz, Heidenheim, Fed. Rep. of Germany

[73] Assignee: J. M. Voith GmbH, Fed. Rep. of Germany

[21] Appl. No.: 547,517

[22] Filed: Jul. 2, 1990

[51] Int. Cl.[5] ..... D21F 5/04

[52] U.S. Cl. ..... 34/117; 34/120

[58] Field of Search ..... 34/117, 115, 120, 113, 34/116; 162/193, 194, 368, 286, 255

[56] References Cited

U.S. PATENT DOCUMENTS 4,945,655 8/1990 Wedel ..... 34/117 X

FOREIGN PATENT DOCUMENTS

WO90/01580 2/1907 PCT Int'l Appl. .

WO90/02225 3/1990 PCT Int'l Appl. .

OTHER PUBLICATIONS

Journal "Wochenblatt fur Papierfabrikation", No. 22, 1988, p. 6.

*Primary Examiner*—Henry A. Bennet

*Attorney, Agent, or Firm*—Ostrolenk, Faber, Gerb & Soffen

[57] ABSTRACT

The dry end or dryer section of a paper making machine has a plurality of dryer groups. Each dryer group comprises a plurality of heatable dryer cylinders, reversing rolls between each pair of the dryer cylinders in the group and an endless web support belt which passes over a dryer cylinder and then a reversing roll and then the next dryer cylinder in turn in the group. Between the last two dryer cylinders with which the lower side of the web comes into contact, there is an auxiliary guide roll over which the support belt travels free of the web, while the web travels directly from the selected dryer cylinder to the next reversing roll. Alternately, the auxiliary guide roll is disposed between the reversing roll and the next dryer cylinder in the web path of travel. Between the dryer cylinder and the auxiliary guide roll can be provided a second auxiliary guide roll which presses the web against the belt before the web separates from the web to pass to the auxiliary guide roll. A tip cutter is arranged on the free or unsupported stretch of the web. Other reversing roll arrangements are disclosed for separating the web from the support belt so that the tip cutter can act on the free stretch of the web.

25 Claims, 3 Drawing Sheets

WEB AND SUPPORT BELT SEPARATION FOR DRY END OF PAPER MACHINE

BACKGROUND OF THE INVENTION

The present invention relates to the dry end or dryer section of a machine for the manufacture of a fibrous web, particularly a web of paper. In particular, the invention concerns a dry end of the type which is formed exclusively of so-called single-screen dryer groups. Dry ends of this type are known from the following publications.

1. Journal "Wochenblatt fur Papierfabrikation", No. 22, 1988, page 6.
2. WO 90/01580, corresponding to U.S. application Ser. No. 230,627, filed Aug. 10, 1988.
3. WO 90/02225, corresponding to U.S. application Ser. No. 235,394, filed Aug. 23, 1988.

These publications disclose that the dryer cylinders can be arranged either in at least approximately horizontal rows or in at least approximately vertical rows at least over the greater part of the dry end. It is further known that to subdivide such a dry end into several dryer groups, wherein each dryer group comprises a plurality of heatable dryer cylinders, a plurality of guide rolls and a support belt which presses the web which is to be dried against the dryer cylinders.

From above Publication 1., it is known to provide single-screen dryer groups exclusively between the press section and the calender of the paper machine. However, there are also paper machines in which a dry end consisting exclusively of single-screen dryer groups extends from the press section up to a size press or a similar intermediate station, or from a size press to a calender.

It is further known from such publications that the bottom side of the web always comes into contact with the dryer cylinders in the last dryer group. In this way, the web travels in the downward direction, in particular, from the last dryer cylinder in the downward direction. In this way, in case of any disturbance, the web can be easily removed in the downward direction into a broke pulper.

From above Publications 2. and 3., it is known that a tip cutter must be installed at the end of the dry end. As long as the web travels into the broke pulper, the tip cutter can cut a narrow edge strip from the web. This strip then serves for threading the web into the following treatment stations, for instance calender and reel, or size press, or the like. A free stretch or draw of web is formed for such a tip cutter by means of a special arrangement of rollers, since upon the cutting of the tip, the web must be free of the support belt which otherwise travels with the web.

In Publication 2., the free stretch or draw of web is formed at the place of separation between the next-to-the-last and the last dryer groups, and therefore at a place where the web is still not completely dry. Thus, there is a danger that the web will tear upon the cutting of the tip. On the other hand, if necessary, use can be made of the possibility of controlling the web tension upon the cutting of the tip, by changing the difference in speed between the two dryer groups.

In Publication 3., the free stretch or draw of the web is formed within the last group of dryers, preferably between the last two dryer cylinders, and therefore at a place where the web is completely dry. Thus, the web only rarely tears upon the cutting of the tip. Between the last two dryer cylinders, there is a reversing roll with which the support belt comes into direct contact. In addition, a web guide roll is arranged below this reversing roll. The web travels, free of the support belt, from the reversing roll to the web guide roll and from the guide roll back to the reversing roll so that two free stretches of web are present. The aforementioned tip cutter is arranged on one of these two free stretches or draws of web. With this arrangement, there is the danger that upon tearing of the web or upon some other unstable operating condition, the web will wind up on the web guide roll. Furthermore, this has the disadvantage that two free stretches of web are present, although only a single free stretch of web is necessary for the tip cutter. The danger of tearing, which is always present at each free stretch of web, is therefore unnecessarily increased.

SUMMARY OF THE INVENTION

The object of the present invention is so to develop a free stretch of web for a tip cutter in a dry end of the aforementioned type that the danger of the web tearing and wrapping around a roll is at least considerably reduced or preferably entirely eliminated In an apparatus for achieving this object, in a selected dryer group, out of a plurality of dryer groups, in which dryer group it is desired to arrange the tip cutter, an auxiliary guide roll is arranged between a selected dryer cylinder and an adjacent reversing roll. Only the support belt travels over this auxiliary guide roll while a free stretch or draw of web extends between the selected dryer cylinder and the adjacent reversing roll. The tip cutter can be arranged on the free stretch of web. It is essential that the web not come into direct contact with a guide roll in the region of the tip cutter. This avoids a danger of the web winding around a roll. Furthermore, only a single, relatively short, free stretch of the web is present. Accordingly, the danger of tearing of the web is very substantially reduced.

The so called selected dryer group is preferably the last dryer group of the dry end along the path of web travel. From this selected dryer group, the web continues further to a subsequent treatment station, for instance a calender, a size press, or the like.

The apparatus of the invention can be used in two different arrangements. In one arrangement, the "selected dryer cylinder" is preferably the next-to-the-last dryer cylinder of the selected dryer group. In this case, the web of paper travels from the selected dryer cylinder, after which it is separated from the support belt, then over the free web path to the reversing roll, where it again meets the support belt, and from the reversing roll, together with the support belt, in general to the following dryer cylinder which is preferably the last dryer cylinder of the selected dryer group. Instead of the following dryer cylinder, however, any other following guide roll, or cooling roll, or the like can be present.

In another arrangement of the apparatus, the selected dryer cylinder is preferably the last or next-to-the-last dryer cylinder of the selected dryer group. In this case the web travels, for instance, from a preceding dryer cylinder or from a preceding guide roll together with the support belt to the preceding reversing roll which precedes the selected dryer cylinder. At that reversing roll, the web and the support belt are separated. The web travels separated from the support belt from the reversing roll directly in a free stretch of web to the selected dryer cylinder so that the tip cutter can be arranged here. The support belt, free of the web of paper, travels from the reversing roll over the auxiliary guide roll and then to the selected dryer cylinder where it again meets the web.

In order for the web to be pressed by the support belt against the cylinder shell around the largest possible part of the circumference of the selected dryer cylinder, an additional auxiliary guide roll can be provided for the web in the vicinity of the selected dryer cylinder.

In an alternative arrangement of the apparatus for achieving the desired purpose, the selected dryer group is divided into a first subgroup and a second subgroup. In this way, the number of support belts and the number of required tensioning and regulating rolls is increased. On the other hand, however, this has the known advantage that the web tension in the region of the tip cutter can be adapted to specific prevailing requirements.

Further details of the various arrangements as well as further embodiments of the invention and examples are explained below on basis of the drawings.

BRIEF DESCRIPTION OF THE DRAWINGS

FIG. 6 shows a dry end in which the dryer cylinders are arranged in predominantly vertical cylinder rows, also with a free stretch of web for the arrangement of a tip cutter.

DESCRIPTION OF THE PREFERRED EMBODIMENTS

Figure 1:
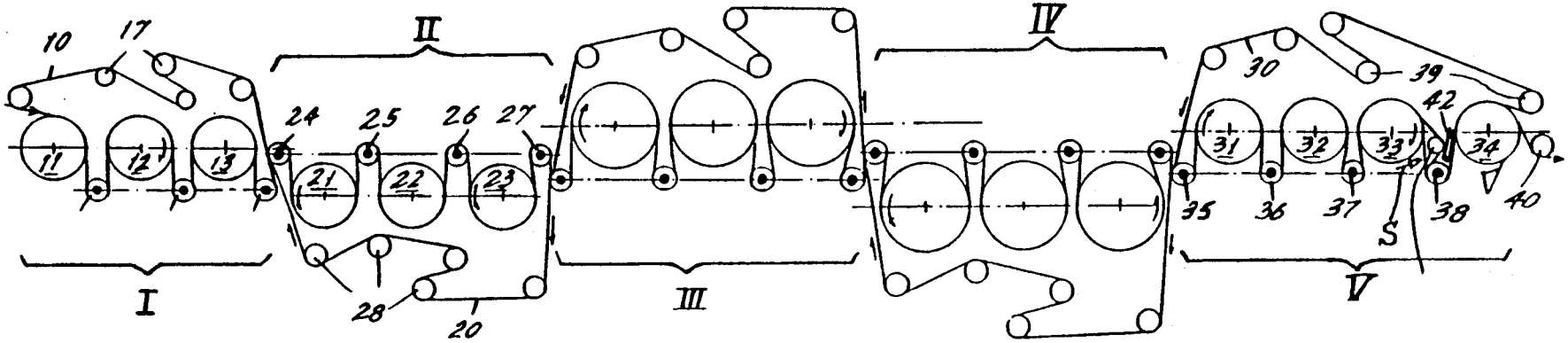
FIG. 1 is a a diagrammatic side view of a dry end or dryer section of a paper making machine with horizontal cylinder rows, with a free stretch of web for a tip cutter.

The dry end or dryer section of a paper making machine shown in FIG. 1 comprises five dryer groups I through V. For simplifying the showing, each dryer group is shown with only three or four dryer cylinders. Actually, there are usually approximately twice as many dryers in each group. In the first dryer group 1, an endless web support belt 10, e.g. in the form of a felt, passes over the upper circumferential regions of each of the dryer cylinders 11 to 13 and, then following each dryer cylinder, over a respective reversing roll 14 to 16, and then over guide rolls 17 back to the cylinder 11.

In the second dryer group II, an endless support belt 20, e.g. a felt, passes over the lower circumferential regions of each of the dryer cylinders 21, 22 and 23 and then over respective reversing rolls 24 to 37 and over guide rolls 28 back to the first reversing roll 24.

The dryer groups III and IV are developed substantially in the same way as the dryer groups I and II.

Four dryer cylinders 31 to 34 are provided in the dryer group V. The endless, web support belt 30 travels over the upper circumferential regions of each of these dryer cylinders and then over the respective reversing rolls 35 to 38 and guide rolls 39 back to the first reversing roll 35. The reversing rolls 14–16, 24–26 and 35–38 are preferably developed as suction rolls, represented symbolically by a black dot.

The paper web 9 which is to be dried has a top and a bottom surface. In dryer groups I, III and V, the bottom of the web directly contacts the dryer cylinders, while the top of the web directly contacts the dryer cylinders in the drying groups II and IV. At the outlet end of the dry end, the paper web 9 leaves the last dryer cylinder 34 in the downward direction and passes over a paper guide roll 40 to a further treatment station, not shown.

In FIG. 1, the fifth or last dryer group V is the so-called "selected dryer group." Within the dryer group V, the next-to-the-last dryer cylinder 33 is the so-called "selected dryer cylinder." Between the selected dryer cylinder 33 and the following reversing roll 38, an auxiliary guide roll 41 is arranged. The support belt 30 separates from the web at the selected dryer cylinder 33, and then travels from the cylinder 33 without the paper web 9 on the belt, directly to the auxiliary guide roll 41. From the guide roll 41, the belt 30 goes to the reversing roll 38. Meanwhile, the paper web 9, free of the support belt 30, travels directly from the dryer cylinder 33 to the reversing roll 38. There, the paper web 9 and the support belt are again brought together. A tip cutter, arranged along the free stretch or open draw of the web, is indicated symbolically by an arrow S. On the travel path of the support belt from the reversing roll 38 to the following last dryer cylinder 34, a known web stabilizer 42 is arranged on the inner side of the support belt for establishing dependable adherence of the paper web 9 to the support belt 30.

In FIG. 1, the paper web 9 moves in the downward direction through the free path length from the cylinder 33 to the reversing roll 38. This has the advantage that in the event of a tear of the web, particularly upon the entry into action of the tip cutter S, the broke can be discharged downward over the shortest path.

Figure 2:
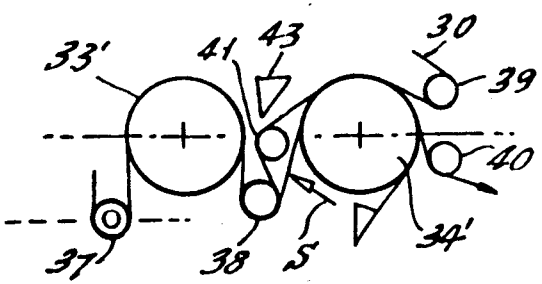
FIG. 2 shows a detail of FIG. 1 with a modified arrangement of a tip cutter.

However, a different arrangement is possible, as shown in FIG. 2. In that case, the last two dryer cylinders are 33' and 34'. The last dryer cylinder 34' is now the "selected dryer cylinder." The support belt in this case travels from the preceding dryer cylinder 33' together with the paper web 9 to the reversing roll 38. After the roll 38, the support belt 30 separates from the web 9 and travels over the auxiliary guide roll 41' to the selected dryer cylinder 34'. The paper web 9 travels from the reversing roll 38 on a direct path, free of support belt 30, to the last dryer cylinder 34' where the web meets the support belt again. The tip cutter S is therefore now arranged on an upward traveling stretch of open draw of the web rather than on a downward stretch as in the arrangement of FIG. 1.

In order that no pressure buildup takes place in the pocket which is present on the reversing roll 38 between the cylinder 33' and the auxiliary guide roll 41', a deflecting ledge for the oncoming air boundary layer, supported by a beam 43, is arranged at the place where the support belt moves off the cylinder 33'.

Figure 3:
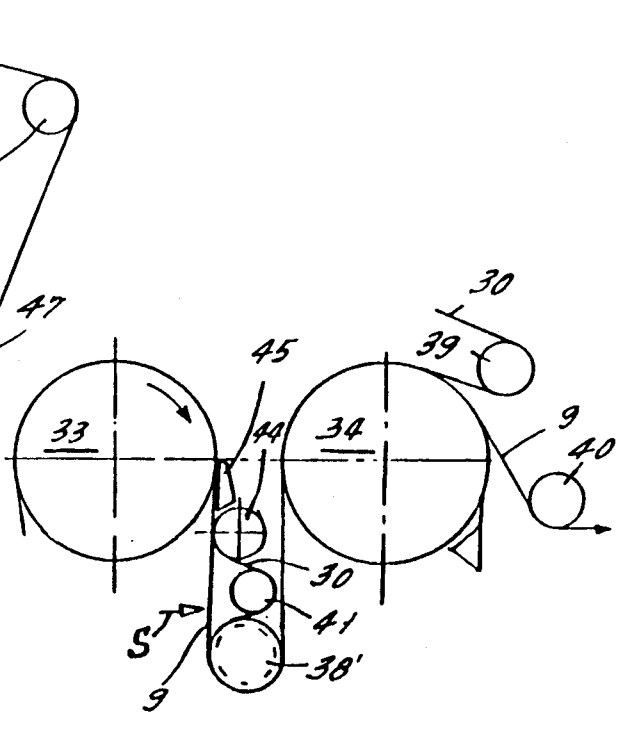
FIGS. 3 to 5 show further possible variants for the arrangement of the tip cutter.

FIG. 3 shows another variant of the arrangement shown in FIG. 1. The reversing roll 38' and the auxiliary guide roll 41 are both at a somewhat greater distance from the horizontal central plane of the dryer cylinders 33 and 34, than in the embodiments of FIGS. 1 and 2. This placement of the rolls 38' and 41 defines a space for an additional auxiliary guide roll 44 which assures that the support belt 30 and the paper web 9 move jointly off the dryer cylinder 33. At this place, there is a web stabilizer 45 which draws the paper web 9 against the support belt 30 at the place of removal. In FIG. 3, the reversing roll 38' is not developed as a suction roll but as a fluted roll without suction means. Therefore, an auxiliary device, which is not shown, for instance, a cable guidance, a blast nozzle, or the like, is necessary upon the threading of the paper web into the dry end to deflect the oncoming tip of the edge strip upward to the dryer cylinder 34. In FIG. 3, however, differing from the showing, the reversing roll 38' can also be developed as suction roll.

Figure 4:
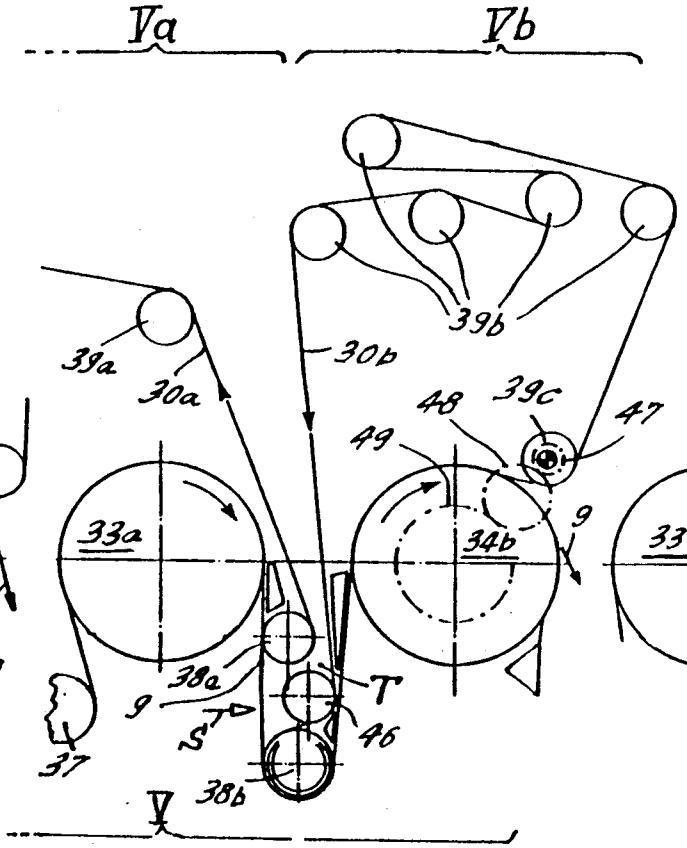

In FIG. 4, the last dryer group V' is divided into a first subgroup Va which has a first support belt 30*a*, and into a second subgroup Vb which has a second support belt 30*b*. The first support belt 30*a* travels from the last dryer cylinder 33*a* of the first subgroup Va together with the web 9 to a last reversing roll 38*a* which is developed as a normal guide roll without suction means. From this reversing roll 38*a*, the first support belt 30*a* travels via guide rolls 39*a* back to the start of the first dryer subgroup Va. The second support belt 30*b* comes from the ordinary guide rolls 39*b*, 39*c* to the reversing roll 38*b* of the second subgroup Vb, comes together there with the paper web 9 and deflects the paper web upward and brings it to the sole dryer cylinder 34*b* of the second subgroup Vb. In order to be able to keep the distance between the dryer cylinders 33*a* and 34*b* small, the two reversing rolls 38*a* and 38*b* are arranged one above the other in the pocket T. That pocket is defined and surrounded by the web passing between the dryer subgroups. The clear space between the cylinders 33*a* and 34*b* is small, about the diameter of the one reversing roll 38*a* at the bottom of the pocket T. Furthermore, between the two reversing rolls 38*a* and 38*b* there is provided an auxiliary guide roll 46 which feeds the second support belt 30*b* to the bottom reversing roll 38*b* of the second subgroup Vb. The reversing roll 38*b* is developed as a suction roll. A few web stabilizers (without reference numbers) are also shown diagrammatically.

The following modifications are possible. The second subgroup Vb may have not only one but two or more dryer cylinders and, accordingly, additional reversing rolls. The last reversing roll 38*a* can lie in the bottom of the pocket T and be developed as suction roll. The reversing roll 38*b* can lie above the auxiliary guide roll 46 and have a small suction zone at the place where the web 9 coming from below combines with the second support belt 30*b*.

In all cases the web of paper 9 extends, without contact with one of the support belts, from the one reversing roll 38*a* to the other reversing roll 38*b* completing the pocket T. A tip cutter S is again arranged on this free stretch or open draw of the web. However, the configuration of either FIG. 4 or FIG. 5 can also be used without a tip cutter as a separation of the two adjacent dryer groups, with the same side of the web coming into contact with the dryer cylinders in both dryer groups. This type of group separation is more easily controlled, for instance, in the event of a tear of the web, than the configuration in accordance with FIG. 5 of U.S. Pat. No. 4,359,827 or FIG. 1 of U.S. Pat. No. 4,625,430.

If, as shown, a tip cutter S is present, then the lower side of the web must come into contact with the dryer cylinders 33*a* and 34*b* in both subgroups Va and Vb. In other words, the dryer cylinders lie on top in both subgroups Va and Vb. This is the same as in FIG. 1 where the dryer cylinders of dryer groups I, III and V lie on the top while the dryer cylinders of dryer groups II and IV lie on the bottom.

With the arrangement in FIG. 4 as a typical example, the dry end can be divided into dryer groups as follows:

| | |
|---|---|
| Dryer group I: | five upper cylinders, |
| Dryer group II: | six lower cylinders, |
| Dryer group III: | seven upper cylinders, |
| Dryer group IV: | seven lower cylinders, |
| Dryer group V: | |
| First subgroup: | seven upper cylinders, |
| Second subgroup: | one upper cylinder |
| Total number of dryer cylinders: | 33. |

In contrast to this, with the arrangement of a tip cutter in accordance with above noted prior art Publication 2. again as an example, the following division into groups would be necessary:

| | |
|---|---|
| Dryer group I: | five upper cylinders |
| Dryer group II: | five lower cylinders |
| Dryer group III: | five upper cylinders |
| Dryer group IV: | five lower cylinders |
| Dryer group V: | six upper cylinders |
| Dryer group VI: | six lower cylinders |
| Dryer group VII: | one upper cylinder |

The total number of dryer cylinders would again be 33. With this arrangement, therefore, an additional support belt and the corresponding guide, tensioning, and regulating rolls would be necessary.

A group division with a tip-cutter arrangement in accordance with FIGS. 1 to 3 would be even more favorable than with FIG. 4, namely, for instance, the following:

| | |
|---|---|
| Dryer group I: | five upper cylinders, |
| Dryer group II: | six lower cylinders, |
| Dryer group III: | seven upper cylinders, |
| Dryer group IV: | seven lower cylinders, |
| Dryer group V: | eight upper cylinders. |

Here, as shown in FIG. 1, only five support belts are necessary. The total number of dryer cylinders would again be 33.

FIG. 4 furthermore diagrammatically indicates that not only the dryer cylinder 34*b* but also one of the guide rolls and preferably the guide roll 39*c* directly following the cylinder 34*b* is provided with a drive. The two drives can, as shown, be connected to each other by gears 47, 48, 49. This assures that even in the case of only a single dryer cylinder 34*b* in the second subgroup Vb, the web tension in the free web portion always has the desired value, for instance, even if the web should tear between the dryer cylinder 34*b* and the following units. Instead of the guide roll 39*c* being driven, the reversing roll 38*b* could also be driven.

Figure 5:
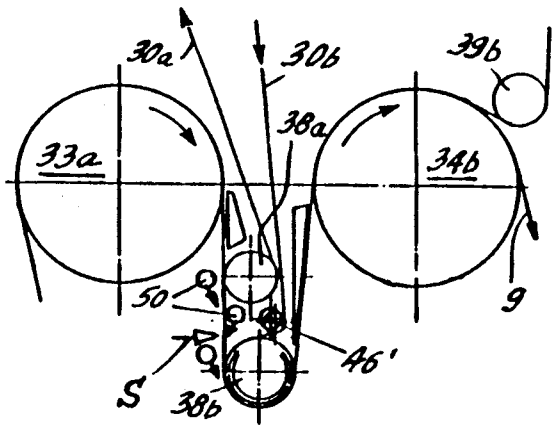
Figure 5:
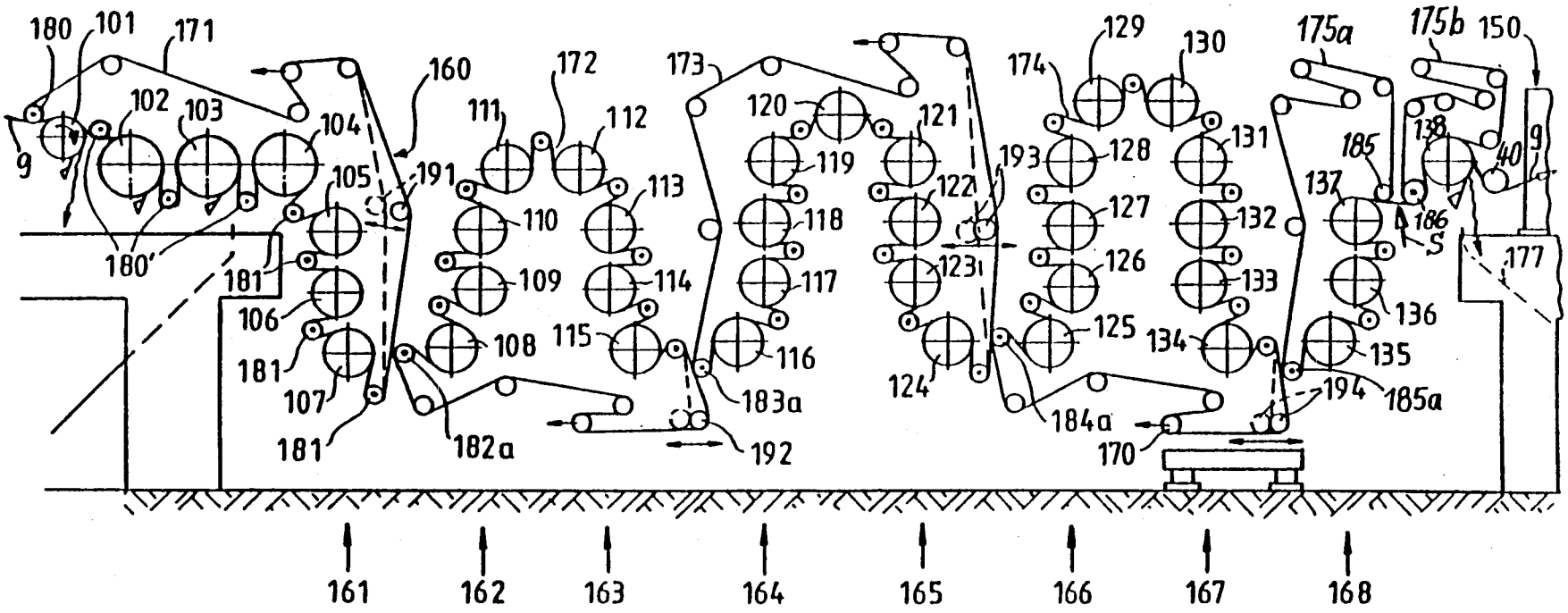

The arrangement in FIG. 5 differs from the one in FIG. 4 substantially only in the fact that the auxiliary guide roll 46' is developed as a multi-member roll, for instance, as a spreading roll. Such a spreading roll requires less space than an ordinary guide roll. Furthermore, blast nozzles 50 are indicated in FIG. 5 on the free web section. Those nozzles guide the oncoming tip of the edge strip dependably toward the suction roll 38*b* upon the threading of the web 9 into the dry end. Instead of using the blast nozzles 50, airfoil elements utilizing the Coanda effect or similar means could also be provided.

The dry end or drying section shown in FIG. 6 comprises a first horizontal row of cylinders 160 and a total of eight substantially vertical dryer cylinder rows 161-168 connected one after the other in the path of web travel. At the right-hand end of FIG. 6, one can note a part of a calender 150 which follows the dry end. It can be seen that, by the arrangement of the greatest part of the dryer cylinders 105-138 in vertical rows, the length of the dry end is substantially shorter than with an ordinary arrangement of dryer cylinders in horizontal cylinder rows.

The first dryer group in FIG. 6, formed of the cylinder rows 160 and 161, has an endless support belt 171. It first travels over a suction guide roll 180 where the support belt takes the web 9 over from the press section and feeds it to the first dryer cylinder 101. From here, the support belt 171 and the paper web travel together in succession over the reversing suction guide rolls 180' and 181 and the cylinders 102, 107, with the lower side of the web contacting the cylinders. From the lowermost suction guide roll 181, the web is transported by the support belt 171 in the direction toward the second dryer group 162/163.

As a whole, the dry end shown in FIG. 6 has five dryer groups. Each group has its own respective support belt 171-175. The guide rolls for these support belts 171-175 are only diagrammatically shown: an ordinary guide roll as a plain circle, a suction guide roll as a circle with a dot, and a tensioning roll as a circle with a single arrow, for instance, roll 170. Some of the ordinary guide rolls 191-194 are provided with a double-ended arrow. This means that they are substantially displaceable horizontally.

The two vertical cylinder rows 162 and 163 together form a double row dryer group, i.e. the eight cylinders 108-115 have a common support belt 172. This conducts the web to be dried, starting from a pickup roll 182*a*, first upward over the cylinders 108-111 and then downward over the cylinders 112-115. In this entire dryer group, the upper side of the web always comes into contact with the cylinders.

In similar fashion, the two cylinder rows 164 and 165 form, together with an upper middle dryer cylinder 120, another double row dryer group having a common support belt 173. That belt takes over the web by means of a pickup roll 183*a* and conducts the web, first upward over the cylinders 116-120 and then downward over the cylinders 120-124 In this connection, the lower side of the web always comes into contact with the dryer cylinders as in the first dryer group 160/161. This is followed by another dryer group which is formed of the two cylinder rows 166-167 and has the support belt 174. The construction of this dryer group is practically identical to that of the second dryer group 162/163, except that there are two more cylinders. The last four dryer cylinders 135-138 form a final dryer group 168.

The web 9 travels from the last cylinder 138 freely and without support over a paper guide roll 40 into the calender 150. It is important that the last dryer cylinder row 168 be traversed by the web in the upward direction and that the uppermost dryer cylinder 138 of this row lies closer to the calender 150 than the other dryer cylinders 135-137. This causes the finally dried web to discharge in the downward direction from the last cylinder 138. If the web now temporarily does not pass further to the calender 150, it can drop down freely and is conducted further over an oblique wall 177 into a broke pulper, not shown.

The last dryer group 168 is again divided into two subgroups. The first subgroup comprises the dryer cylinders 135-137 and has a support belt 175*a*. The second subgroup has only a single dryer cylinder 138 and one support belt 175*b*. Paper web 9 and support belt 175*a* travel first from the last dryer cylinder 137 of the first subgroup jointly to an ordinary guide roll 185. From here the support belt 175*a* travels back to the pickup roll 185*a* while the paper web 9 travels freely to the first and sole reversing roll, the suction guide roll 186 of the second subgroup. A tip cutter S is again arranged on this free stretch of web. At the reversing roll 186, the paper web 9 comes together with the support belt 175*b*, which conducts it to the last dryer cylinder 138.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

What is claimed is:

1. A dryer section of a machine for fabricating a fiber web, of paper, the web to be dried having an upper and a lower side;

the dryer section comprising: plurality of groups of dryers; each dryer group comprising a plurality of heatable dryer cylinders, a plurality of reversing rolls, with each of the reversing rolls being disposed between two of the dryer cylinders, and a respective support belt for the dryer group for passing over one dryer cylinder in the dryer group, then over one of the reversing rolls and then over the next dryer cylinder in the group, the support belt being adapted for transporting the web to be dried to travel together with the support belt first over one the one dryer cylinder, then over the reversing roll, and then over the next dryer cylinder, wherein a web is placeable on the support belt so that the web comes into direct contact with the dryer cylinders and the support belt comes into direct contact with the reversing rolls;

in a selected one of the dryer groups, the reversing rolls and the support belt being so oriented that the lower side of the web directly contacts the dryer cylinders;

an auxiliary guide roll arranged between a selected one of the dryer cylinders in the, selected dryer group and an adjacent one of the reversing rolls for the support belt to pass over both the auxiliary guide roll and the adjacent reversing roll for providing a free stretch of the web between the one selected dryer cylinder and the adjacent reversing roll without the web passing over the auxiliary guide roll;

a tip cutter arranged at the free stretch of the web.

2. The dryer section of claim 1, wherein the reversing rolls between neighboring dryer cylinders in the dryer groups ar suction rolls.

3. The dryer section of claim 1, wherein the one selected dryer cylinder is located upstream of the free stretch of web as seen in the direction of travel of the web and the auxiliary guide roll is downstream of the selected dryer cylinder; while free of the web, the support belt traveling from the selected dryer cylinder to the auxiliary guide roll, and then from the auxiliary guide roll to the reversing roll, while the web travels from the selected dryer cylinder to the reversing roll without passing over the auxiliary guide roll, defining thereby the free stretch of the web.

4. The dryer section of claim 3, further comprising an additional guide roll disposed between the one selected dryer cylinder and the auxiliary guide roll, the additional guide roll being located for pressing the support belt against the web before the web separates from the support belt and before the support belt moves to the auxiliary guide roll.

5. The dryer section of claim 1, wherein the one selected dryer is located downstream of the free stretch of web as seen in the direction of travel of the web; the support belt traveling from the respective selected reversing roll that is upstream of the selected dryer cylinder to the auxiliary guide roll which is upstream of the selected dryer cylinder, and from the auxiliary guide roll to the selected dryer cylinder, while the web travels free of support of the support belt from the reversing roll that is upstream of the selected dryer cylinder to the selected dryer cylinder; and the tip cutter is at the free stretch of the web between the selected reversing roll and the one selected dryer cylinder.

6. The dryer section of claim 1, further comprising an additional guide roll disposed between the one selected dryer cylinder and the auxiliary guide roll, the additional guide roll being located for pressing the support belt against the web upstream of the free stretch of the web and upstream of where the web separates from the support belt and before the support belt moves to the auxiliary guide roll.

7. A dryer section of a machine for fabricating a fiber web, of paper, the web to be dried having an upper and lower side;

the dryer section comprising:

a plurality of groups of dryers; each dryer group comprising a plurality of heatable dryer cylinders, a plurality of reversing rolls, with each of the reversing rolls being disposed between two of the dryer cylinders, and a respective support belt for the dryer group for passing over one dryer cylinder in the dryer group, then over one of the reversing rolls and then over the next dryer cylinder in the group, the support belt being adapted for transporting the web to be dried to travel together with the support belt first over the one dryer cylinder, then over the reversing roll, and then over the next dryer cylinder, wherein a web is placeable on the support belt so that the web comes into direct contact with the dryer cylinders, and the support belt comes into direct contact with the reversing rolls;

in a selected one of the dryer groups, the dryer cylinders being divided into a first subgroup of dryer cylinders and a second subgroup of dryer cylinders; a respective first one of the support belts for the first subgroup of dryer cylinders and passing over and in engagement with the first subgroup of dryer cylinders, and a respective second one of the support belts for the second subgroup of dryer cylinders and passing over and in engagement with the second subgroup of dryer cylinders; the reversing rolls and the support belts of the first and second subgroups being so oriented that the lower side of the web directly contacts the dryer cylinders in the first and second subgroups;

the first subgroup having a final one of the dryer cylinders at the end of the path of travel of the web through the first subgroup and having a final one of the reversing rolls following the final dryer cylinder in the first subgroup, the first support belt traveling together with the web from the final dryer cylinder to the final reversing roll;

the second subgroup having an initial dryer cylinder in the travel path of the web and an initial reversing roll located upstream of the initial dryer cylinder in the path of the web, the second support belt itself feeding from the initial reversing roll of the second subgroup, together with and supporting the web on the second support belt, to the initial dryer cylinder;

the initial reversing roll of the second subgroup being spaced away from the final reversing roll of the first subgroup to define a free unsupported stretch of the web between the final reversing roll and the initial reversing roll; and the tip cutter being arranged at the free length of the web.

8. A dryer section of a machine for fabricating a fiber web, of paper, the web to be dried having an upper and lower side;

the dryer section comprising:

a plurality of groups of dryers; each dryer group comprising a plurality a heatable dryer cylinders, a plurality of reversing rolls, with each of the reversing rolls being disposed between two of the dryer cylinders, and a respective support belt for the dryer group for passing over one dryer cylinder in the dryer group, then over one of the reversing rolls and then over the next dryer cylinder in the group, the support belt being adapted for transporting the web to be dried to travel together with the support belt first over the one dryer cylinder, then over the reversing roll, and then over the next dryer cylinder, wherein a web is placeable on the support belt so that the web comes into direct contact with the dryer cylinders, and the support belt comes into direct contact with the reversing rolls: 'in a selected one of the dryer groups, the dryer cylinders being divided into a first subgroup of the dryer cylinders and a second subgroup of dryer cylinders; a respective first one of the support belts for the first subgroup of dryer cylinders and passing over and in engagement with the first subgroup of dryer cylinders, and a respective second one of the support belts for the second subgroup of dryer cylinders and passing over and in engagement with the second subgroup of dryer cylinders; the reversing rolls and the support belts of the first and second subgroups being so oriented that the lower side of the web directly contact the dryer cylinders in the first and second subgroups;

the first subgroup having a final one of the dryer cylinders at the end of the path of travel of the web through the first subgroup and having a final one of the reversing rolls following the final dryer cylinder in the first subgroup, the first support belt traveling together with the web from the final dryer cylinder to the final reversing roll;

the second subgroup having an initial dryer cylinder in the travel path of the web and an initial reversing roll located upstream of the initial dryer cylinder in the path of the web, the second support belt itself feeding from the initial reversing roll of the second subgroup, together with and supporting the web on the second support belt, to the initial dryer cylinder;

the initial reversing roll of the second subgroup being spaced away from the final reversing roll of the first subgroup to define a free unsupported stretch of the web between the final reversing roll and the initial reversing roll;

the final reversing roll of the first subgroup and the initial reversing roll of the second subgroup being so placed as to define a pocket which is defined by the web travel path from the final dryer cylinder of the first subgroup to the initial dryer cylinder of the second subgroup and over the final reversing roll and the initial reversing roll; the pocket having a bottom defined by the one of the final reversing roll of the first subgroup and the initial reversing roll of the second subgroup that is lower at the bottom of the pocket; and the tip cutter being arranged at the free length of the web.

9. The dryer section of claim 8, wherein there is a clear distance between the final dryer cylinder of the first subgroup and the initial dryer cylinder of the second subgroup, and that distance is approximately the diameter of the reversing roll which lies at the bottom of the pocket.

10. The dryer section of claim 8, further comprising an auxiliary guide roll disposed between the initial and final reversing rolls in the pocket, the respective one of the first and second support belts that travels over the reversing roll that is at the bottom of the pocket further passes over the auxiliary guide roll, and the auxiliary guide roll helps position the support belts moving through the pocket to maintain them out of engagement with each other.

11. The dryer section of claim 9, wherein the auxiliary guide roll comprises a spreader roll.

12. The dryer section of claim 9, wherein it is the initial reversing roll of the second subgroup that is at the bottom of the pocket.

13. The dryer section of claim 8, wherein in at least the second subgroup, the initial dryer cylinder and a respective one of the reversing rolls for the second support belt in the second subgroup are drivable; drive means for driving both the initial dryer cylinder and the drivable reversing roll.

14. The dryer section of claim 1, wherein the dryer cylinders in each of the dryer groups are arranged in a row and each of the rows is at least an approximately horizontal row, at least in the predominating part of the dryer section.

15. The dryer section of claim 1, wherein the dryer cylinders are arranged in a plurality of rows thereof and at least in the predominating part of the dryer section, the rows of dryer cylinders are at least approximately vertical rows.

16. The dryer section of claim 14, wherein the respective dryers of at least some of the dryer groups are in two of the rows.

17. The dryer section of claim 1, further comprising guide elements in the region of the free web length for guiding the tip of the edge strip.

18. The dryer section of claim 17, wherein the guide elements comprise blast nozzles.

19. The dryer section of claim 1, wherein each of the support belts is an endless belt which passes over the dryer cylinders and the reversing rolls in the respective dryer group, guide rolls in the respective dryer groups and the respective support belt for the respective groups additionally passing over the guide rolls of the group.

20. A dryer section of a machine for fabricating a fiber web, of paper, the web to be dried having an upper and a lower side;

the dryer section comprising:

a plurality of dryer groups; each dryer group comprising a heatable dryer cylinder, a respective reversing roll near the dryer cylinder, and a respective support belt for passing over the dryer cylinder in the group and then over the respective reversing roller for the dryer cylinder, the support belt being adapted for transporting the web to be dried to travel with the support belt over the dryer cylinder and over the reversing roll, wherein a web is placeable on the support belt so that the web comes into direct contact with the dryer cylinder, and the support belt comes into direct contact with the reversing roll;

in a selected one of the dryer groups, the reversing roll and the support belt being so oriented that the lower side of the web directly contacts the dryer cylinder which is a selected dryer cylinder;

an auxiliary guide roll arranged between the selected dryer cylinder in the reversing roll near the selected dryer cylinder, for the support belt to pass over the auxiliary guide roll and then to the near reversing roll for providing a free length of the web between the selected dryer cylinder and the near reversing roll, without the web passing over the auxiliary guide roll;

a tip cutter arranged at the free length of the web.

21. The dryer section of claim 20, wherein the selected dryer cylinder is located upstream of the free stretch of web as seen in the direction of travel of the web and the auxiliary guide roll is downstream of the selected dryer cylinder; while free of the web, the support belt travelling from the selected dryer cylinder to the auxiliary guide roll, and from the auxiliary guide roll to the near reversing roll, while the web travels from the selected dryer cylinder to the near reversing roll without passing over the auxiliary guide roll, defining thereby the free length of the web.

22. The dryer section of claim 19, further comprising an additional guide roll disposed between the selected dryer cylinder and the auxiliary guide roll, the additional guide roll being located for pressing the support belt against the web before the web separates from the support belt and before the support belt moves to the auxiliary guide roll.

23. The dryer section of claim 20, wherein the selected dryer cylinder is located downstream of the free stretch of web as seen in the direction of travel of the web; the support belt traveling from the near reversing roll that is upstream of the selected dryer cylinder to the auxiliary guide roll which is upstream of the selected dryer cylinder, and from the auxiliary guide roll to the selected dryer cylinder, while the web travels free of support of the support belt from the near reversing roll that is upstream of the selected dryer cylinder to the selected dryer cylinder; and the tip cutter is at the free stretch of the web between the near reversing roller and the selected dryer cylinder.

24. The dryer section of claim 20, wherein in the selected dryer group, there is a plurality of the dryer cylinders and there is a respective near reversing roll disposed between each two of the dryer cylinders, and the respective support belt for the selected dryer group passing over one side of one dryer cylinder in the selected dryer group, then over the near reversing roll following the one dryer cylinder and then over the next dryer cylinder in the selected dryer group.

25. A dryer section of a machine for fabricating a fiber web, of paper or the like, the web to be dried having an upper and lower side;

the dryer section comprising:

a plurality of groups of dryers; each dryer group comprising a plurality of heatable dryer cylinders, a plurality of reversing rolls, with each of the reversing rolls being disposed between two of the dryer cylinders, and a respective support belt for the dryer group for passing over one dryer cylinder in the dryer group, then over one of the reversing rolls and then over the next dryer cylinder in the group, the support belt being adapted for transporting the web to be dried to travel together with the support belt first over the one dryer cylinder, then over the reversing roll, and then over the next dryer cylinder, wherein a web is placeable on the support belt so that the web comes into direct contact with the dryer cylinders, and the support belt comes into direct contact with the reversing rolls:

in a selected one of the dryer groups, the dryer cylinders being divided into a first subgroup of the dryer cylinders and a second subgroup of dryer cylinders; a respective first one of the support belts for the first subgroup of dryer cylinders and passing over and in engagement with the first subgroup of dryer cylinders, and a respective second one of the support belts for the second subgroup of dryer cylinders and passing over and in engagement with the second subgroup of dryer cylinders; the reversing rolls and the support belts of the first and second subgroups being so oriented that the lower side of the web directly contacts the dryer cylinders in the first and second subgroups;

the first subgroup having a final one of the dryer cylinders at the end of the path of travel of the web through the first subgroup and having a final one of the reversing rolls following the final dryer cylinder in the first subgroup, the first support belt traveling together with the web from the final dryer cylinder to the final reversing roll;

the second subgroup having an initial dryer cylinder in the travel path of the web and an initial reversing roll located upstream of the initial dryer cylinder in the path of the web, the second support belt itself feeding from the initial reversing roll of the second subgroup, together with and supporting the web on the second support belt, to the initial dryer cylinder;

the initial reversing roll of the second subgroup being spaced away from the final reversing roll of the first subgroup to define a free unsupported stretch of the web between the final reversing roll and the initial reversing roll, the final reversing roll of the first subgroup and the initial reversing roll of the second subgroup being so placed as to define a pocket which is defined by the initial reversing roll of the second subgroup that is lower at the bottom of the pocket; and the tip cutter being arranged at the free length of the web.

* * * * *